US009700745B1

(12) United States Patent
Bohrer

(10) Patent No.: US 9,700,745 B1
(45) Date of Patent: Jul. 11, 2017

(54) FIRE EXTINGUISHING SYSTEM FOR STOVE TOPS

(71) Applicant: Darrell Bohrer, Fulton, MS (US)

(72) Inventor: Darrell Bohrer, Fulton, MS (US)

( * ) Notice: Subject to any disclaimer, the term of this patent is extended or adjusted under 35 U.S.C. 154(b) by 0 days.

(21) Appl. No.: 15/072,515

(22) Filed: Mar. 17, 2016

(51) Int. Cl.

| | |
|---|---|
| ***A62C 3/00*** | (2006.01) |
| ***A62C 2/04*** | (2006.01) |
| ***A62C 35/02*** | (2006.01) |
| ***A62C 37/12*** | (2006.01) |
| ***A62C 35/13*** | (2006.01) |

(52) U.S. Cl.
CPC ..... *A62C 3/006* (2013.01); *A62C 2/04* (2013.01); *A62C 35/026* (2013.01); *A62C 35/13* (2013.01); *A62C 37/12* (2013.01)

(58) Field of Classification Search
CPC ..... A62C 2/04; A62C 3/006; A62C 35/026; A62C 35/11; A62C 35/13; A62C 37/12
See application file for complete search history.

(56) References Cited

U.S. PATENT DOCUMENTS 1,604,380 A * 10/1926 Boyce ..... A62C 3/07 169/35
2009/0321093 A1* 12/2009 Lalouz ..... A62C 3/006 169/57

* cited by examiner

*Primary Examiner* — Christopher Kim
(74) *Attorney, Agent, or Firm* — Robert J. Veal; Veal Intellectual Property, LLC

(57) ABSTRACT

A fire-extinguishing system adapted to be installed above a stove top and to automatically extinguish a fire emanating from a stove top, the fire-extinguishing system including a fire-extinguishing device comprising a pressurized container body adapted to store a fire-extinguishing agent under pressure, a discharge outlet and a discharge head in fluid communication with the discharge outlet. Disposed within the discharge head is a plunger member configured to be retained within the discharge outlet, and a heat sensing element which is adapted to release the plunger element from the discharge outlet when a fire is detected. Once the release plunger is released from the discharge outlet, the fire-extinguishing agent exits the container body through the discharge valve and through a sprinkler head onto the fire emanating from the stove top. The fire-extinguishing system also includes a cut-off control mechanism for terminating power to either a gas or electric stove top by utilization of a thereto-sensitive disc which is activated by excessive heat.

16 Claims, 9 Drawing Sheets

FIRE EXTINGUISHING SYSTEM FOR STOVE TOPS

FIELD OF INVENTION

The present invention relates to a fire-extinguishing system which is installed above a stove top and is adapted to automatically discharge a fire-extinguishing agent upon detection of a fire emanating from the stove top and which also can be adapted to automatically terminate power to the stove top. The fire-extinguishing device is designed for use with either electric or gas stove tops.

BACKGROUND

Numerous fire-extinguishing devices and systems are known in the prior art for use in putting out a cooking fire, the most simple of which is a stand-alone conventional fire extinguisher. A significant drawback to the stand-alone extinguisher is that once it is located, it must be manually discharged. As a result, fire-extinguishing systems have been developed which include heat detecting means located above a stove top along with one or more fire-extinguishing material discharge heads. For example, U.S. Pat. No. 4,256,181 to Searcy, issued Mar. 17, 1981 discloses a fire-extinguishing system that is automatically actuated in response to flames from a fire on the upper surface of a stove having a vent hood. The system utilizes a fusible link, such as a nylon cord, coupled to a link which is secured to the fire-extinguishing valve. A plastic container of flammable material, such as gun powder, surrounds the fusible link and is connected to a fuse which extends below the vent hood. When flames from a fire ignite the fuse, the flammable material within the container is ignited, thereby severing the fusible link and opening up the fire extinguisher valve. There are several disadvantages to Searcy, most notably the use of a flammable material to actuate the fire extinguisher could create a greater danger under certain circumstances. In addition, Searcy does not provide any means for automatically terminating the power to the stove top.

U.S. Pat. No. 6,105,677 to Stager, issued Aug. 22, 2000, discloses the use of one or more fire-extinguishing canisters which are fixedly or pivotally mounted to the vent hood above a stove top, each canister being provided with an opening which is positioned to face downwardly toward the stove top. Each opening is covered by a cap through which a rod surrounded by an elongated compression spring is disposed and retained therein by a fusible plug soldered thereto. The fusible plug is composed of a material which melts upon reaching a predetermined temperature. When a fire occurs, the fusible plug instantly melts, the spring ejects the cap downwardly off the opening and fire-suppressing material contained within the canister is allowed to flow downwardly onto the fire. One drawback to Stager is the cumbersome cap cover/rod/compression spring arrangement. In addition, Stager does not provide means to automatically terminate power to the stove top.

Fire-extinguishing systems which both suppress a stove top fire and shut off the power supply to the stove top also are known in the prior art. For instance, U.S. Pat. No. 6,029,751 to Ford et al., issued Feb. 29, 2000, discloses a fire suppression system which is installed above a stove top comprising a pressurized cylinder containing nitrogen or an inert gas which is connected by piping through a pressure switch to a snap action, temperature activated valve. The temperature activated valve is opened by expansion of a temperature sensitive material, such as a metallic alloy element, within the valve body. Thus, when a fire occurs, the temperature sensitive material expands, the valve opens, and the fire suppressant material is discharged. The system is connected to electronic circuitry that utilizes a radio transmitter and receiver to activate a remote energy removal unit to disconnects the gas or electricity from the stove top. In U.S. Pat. No. 5,871,057 to Stehling et al., issued Feb. 16, 1999, a fire-extinguishing system is disclosed which suppresses a cook top fire with a fire suppressant dispensed through a battery charged nozzle, the batteries also providing current to an acoustic assembly which sounds an alarm and emits a signal to a receiver which shuts off current to the stove top.

U.S. Pat. No. 6,341,655 to Busian et al., discloses an emergency shutdown system for kitchen appliance fires, such as cook stoves. The shutdown system comprises a detection system for detecting a fire in the form of a cable having heat fusible links, a fire extinguisher which is connected by a conduit to discharge valves positioned above the burners of a cook top and a control system having an audible alarm and a visual alarm in the form of a strobe light and connection means to the gas or electric energy source. The system automatically is actuated upon sensing a fire, activating the fire extinguisher, the means for shutting off the stove, and the alarms for indicating the emergency condition.

Other patents which disclose cook stove fire extinguisher installations that comprise means for automatically activating the fire extinguishers and for shutting off the stoves when the fire extinguishers are activated include U.S. Pat. No. 4,813,487 to Mikulec et al., issued Mar. 21, 1989, U.S. Pat. No. 4,830,116 to Walden et al., issued May 16, 1989, U.S. Pat. No. 4,979,572 to Mikulec, issued Dec. 25, 1990, U.S. Pat. No. 5,063,998 to Quinn, issued Nov. 12, 1991 and U.S. Pat. No. 5,297,636 to North, issued Mar. 29, 1994.

Despite the advances of the prior art, a need still exists for a fire-extinguishing system that is adapted both to automatically extinguish a stove top fire and that can be adapted to terminate power automatically to the stove top. Such a fire extinguisher system should include a fire-extinguishing device that is installed quickly and easily above a stove top. Such a fire-extinguishing device should be provided with a discharge head that can be replaced without uninstalling the device. In addition, such a fire-extinguishing device should be capable of having multiple discharge heads. Further, such a fire-extinguishing system should be capable of terminating the power to either a gas or electric stove by simple electrical circuitry without the use of a transmitter/receiver signal. Moreover, such a fire-extinguishing system should be include a mechanism integrated with the fire-extinguishing device to terminate power to a stove top. Such a fire-extinguishing system also should be provided with an audible and/or visual warning alarm. Such a fire-extinguishing system should be inexpensive to manufacture and affordable for purchase by a consumer

SUMMARY OF THE INVENTION

Accordingly, it is an object of the present invention to provide a fire-extinguishing system which comprises a fire-extinguishing device adapted to automatically extinguish a stove top fire and a mechanism for automatically terminating the power to the stove top.

It is also an object of the present invention to provide a fire-extinguishing system which comprises a fire-extinguishing device adapted to automatically extinguish a stove top fire and a mechanism for automatically terminating the power to the stove top integrated with the fire-extinguishing device.

It is another object of the present invention to provide a fire-extinguishing device having a discharge head which is installed quickly and easily above a stove top.

It is a further object of the present invention to provide a fire-extinguishing device having a discharge head that can be replaced without uninstalling the device.

It is still another object of the present invention to provide a fire-extinguishing device capable of having multiple discharge heads.

It is yet another object of the present invention to provide a fire-extinguishing system with an audible and/or visual warning alarm.

It is an additional invention to provide a fire-extinguishing system which is both inexpensive to manufacture and affordable for purchase by a consumer.

Additional objects, advantages and novel features of the invention will be set forth in part of the description which follows, and in part will become apparent to those skilled in the art upon examination of the following specification or may be learned by practice of the invention.

BRIEF DESCRIPTION OF THE DRAWINGS

Referring to the drawings which are appended hereto and which form a portion of this disclosure, it may be seen that.

DETAILED DESCRIPTION

Figure 1:
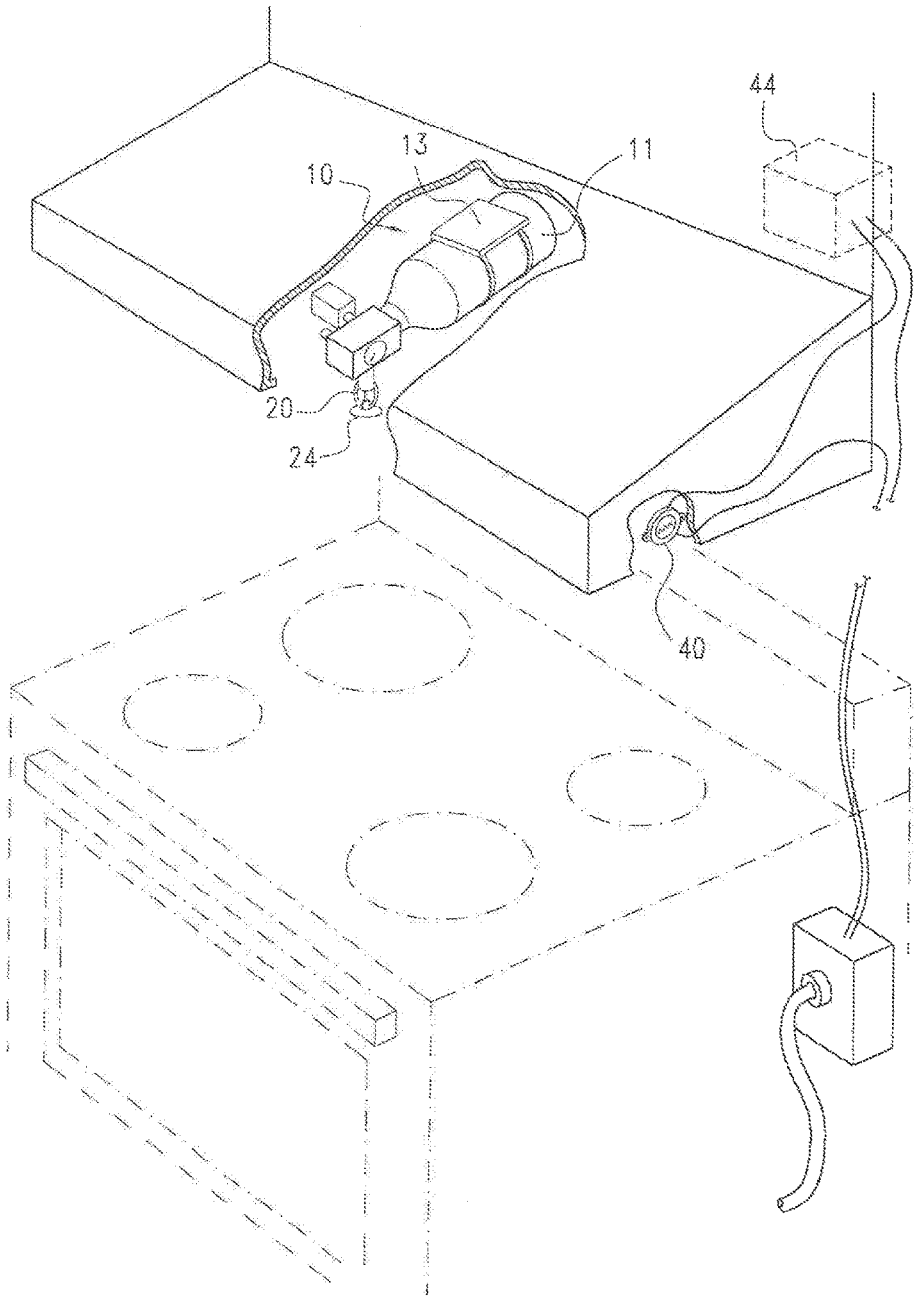
FIG. 1 is an environmental view showing the fire-extinguishing system of the present invention mounted above a stove top.
Figure 2:
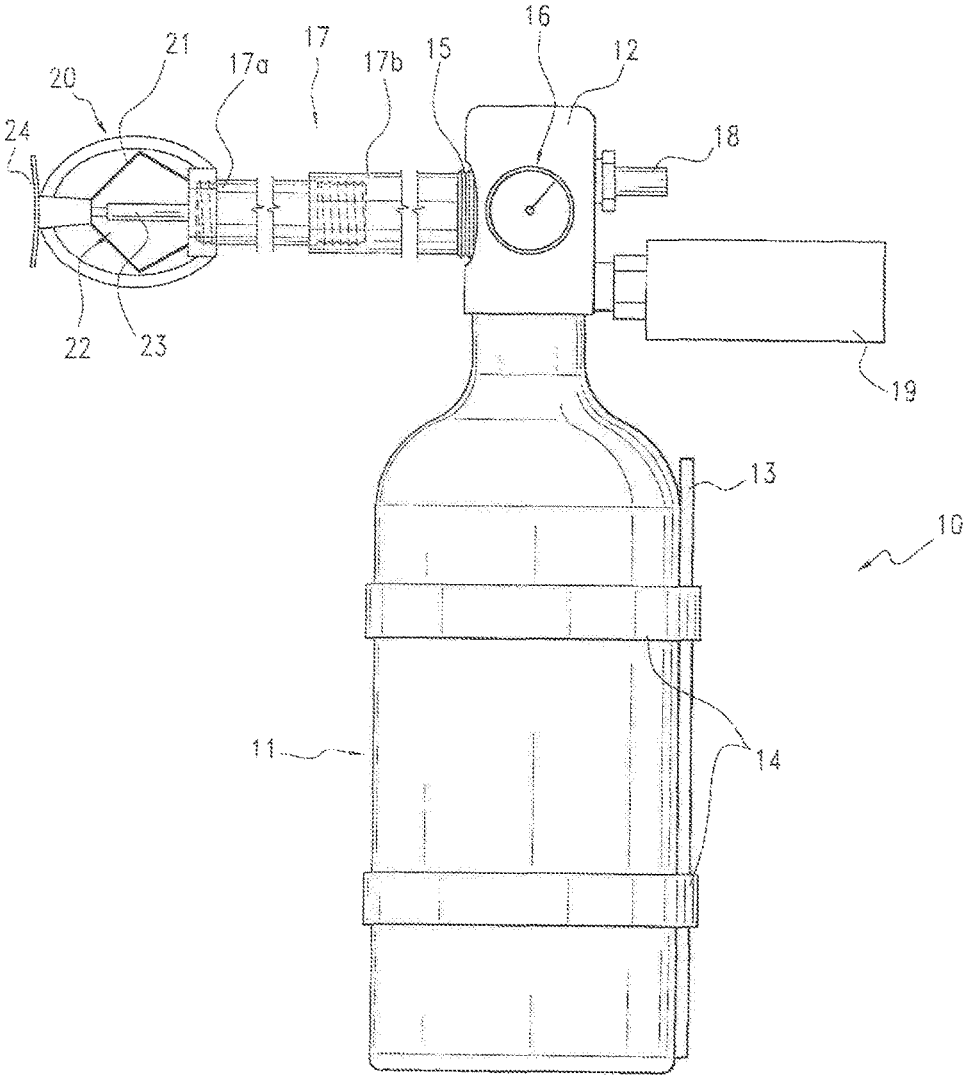
FIG. 2 is a side view of the fire-extinguishing device of the present invention having one sprinkler head.

One or more of the above objects can be achieved, at least in part, by providing to a fire-extinguishing system comprising a fire-extinguishing device adapted to be installed above a stove top and which automatically will extinguish a fire emanating from the stove top and a cut-off control mechanism hick automatically terminates the power to the stove top. The cut-off control mechanism can be a separate from the fire-extinguishing device or integrated therein. More particularly, as shown in FIGS. 1 and 2, the fire-extinguishing device 10 comprises a container body 11 tapering into a dispensing end 12, a mounting mechanism such as bracket 13 and a pair of retaining straps 14 for securing the container body 11 to the mounting bracket 13. A discharge head 20 is fluidly connected to the dispensing end 12 through discharge outlet 15 by means well known in the prior art, such as by threaded engagement. Optionally, an extendable tubing or pipe 17 having first and second threaded ends 17*a* and 17*b* can be used to extend the discharge head 20 outwardly, as shown in FIG. 2. The elongated pipe 17 maybe a telescoping pipe such that the discharge head 20 can be extended to various lengths above the stove top.

The discharge head 20 is provided with a heat sensing element 21 which is adapted to release a plunger member 22 from the discharge outlet 15 at a predetermined temperature. A fire-extinguishing agent is stored in the container body 11 under pressure. Suitable examples of fire-extinguishing agents include foaming agents, such as Ansul 3% Regular Protein Foam Concentrate, manufactured by Ansul Incorporated of Marinette, Wis., as well as non-foaming agents, such as LVS Wet Chemical Agent and Ansulex low pH, also manufactured by Ansul Incorporated. A pressure gauge 16 is provided at the dispensing end 12 to measure the level of pressure within the container body 11, and a fill valve 18 is fluidly connected to the dispensing end 12 for supplying a pressurizing agent, such as nitrogen, to the container body 11.

The fire-extinguishing device 10 of the present invention optimally should be installed and maintained above a stove top, such that it most readily is able to detect a fire emanating from the stove top. The container body 11 may be mounted to any suitable structure typically located above a stove top, including for example, a conventional range hood/fan, a cabinet positioned above the stove top, the ceiling above the stove top or the wall adjacent the stove top. To position and maintain the tire-extinguishing device 10 above a stove top, the mounting bracket 13 first is affixed to the desired structure above the stove top. Suitable securing means for affixing the mounting bracket to the desired structure include for example screws, a conventional nut & bolt arrangement, S-shaped clips and the like. Preferably, the mounting bracket is provided with at least two apertures through which complementary screws or bolts can be introduced in order to affix the mounting bracket to the desired structure.

In order to secure the container body 11 to the mounting bracket 13, the pair of straps 14 are wrapped about the container body and the mounting bracket. Each of the pair of straps has a first end and a complementary second end, such that the first end can be detachably secured to said second end. The pair of straps 14 can be positioned between the mounting bracket and desired structure prior to affixing the mounting bracket to the desired structure, or spacer elements can be utilized between the mounting bracket and desired structure, the spacer elements being of sufficient size such that the pair of straps can be introduced between the mounting bracket and desired structure. IN an alternate embodiment, one or more C-shaped mounting straps can be utilized to mount the container body, replacing the mounting bracket 13 and pair of straps 14.

The heat sensing element 21 is disposed within the discharge head 20. When the heat sensing element reaches a predetermined temperature, the plunger member 22 is released from the discharge outlet 15, thereby causing the fire-extinguishing agent to exit the container body through the discharge outlet and enter the sprinkler head 24 through conduit 23. The fire-extinguishing agent thereafter is sprayed downwardly from the sprinkler head. In this manner, when a fire breaks out on the stove top, the heat sensing ent 21 will be heated by the increased temperature emanating from the fire and release the plunger member 22 from the discharge outlet 15. Once the plunger member is released, the fire-extinguishing agent is discharged from the container body 11 and through the sprinkler head onto the fire.

Preferably, the heat sensing element is composed of a heat fusible material which has a melting temperature of between about 140° F. and about 290° F., preferably between about 220° F. and 250° F. The heat sensing element maybe in the form of a heat fusible polymeric ring, such as a nylon ring. When the heat fusible material melts, the plunger member 22 is released from the discharge outlet.

The fire-extinguishing device of the present invention can be provided with a pressure switch 19 which is in communication with pressure gauge 16. As will be discussed hereinafter, the pressure switch functions as a cut-off control mechanism which is integrated with the fire extinguisher device and is adapted to terminate power to the stove top when the level of pressure in the container body falls below a predetermined level, such as 100 psi.

Discharge head 20 is detachably secured to the discharge outlet 15 of the dispensing end, preferably by complementary threaded engagement. In this manner, after the discharge head has been used and the heat fusible material of the heat sensing element has melted, the used discharge head can be detached from the discharge outlet and a new discharge head can be attached quickly and easily.

Figure 3:
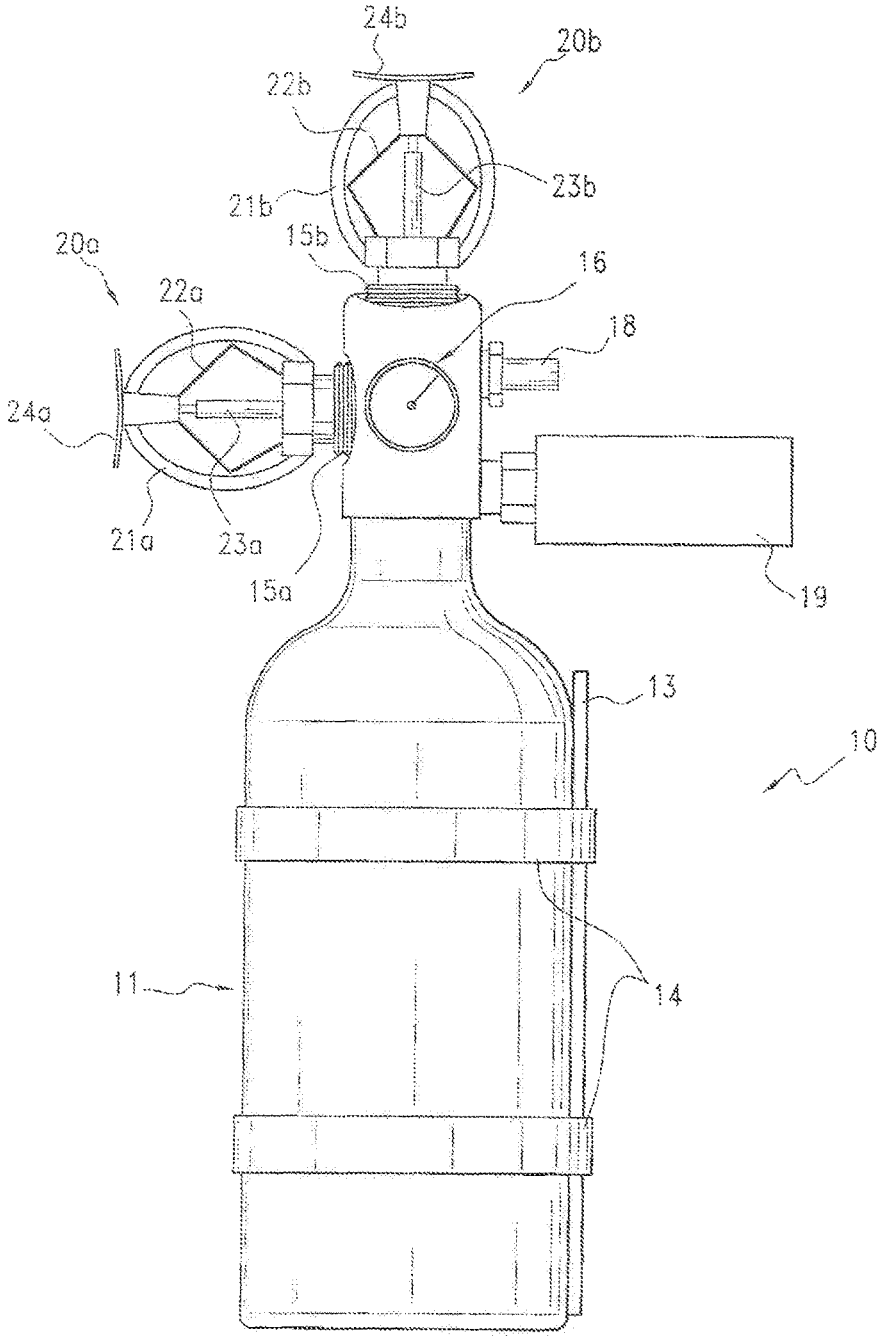
FIG. 3 is a side view of the tire-extinguishing device of the present invention having two sprinkler heads.
Figure 4:
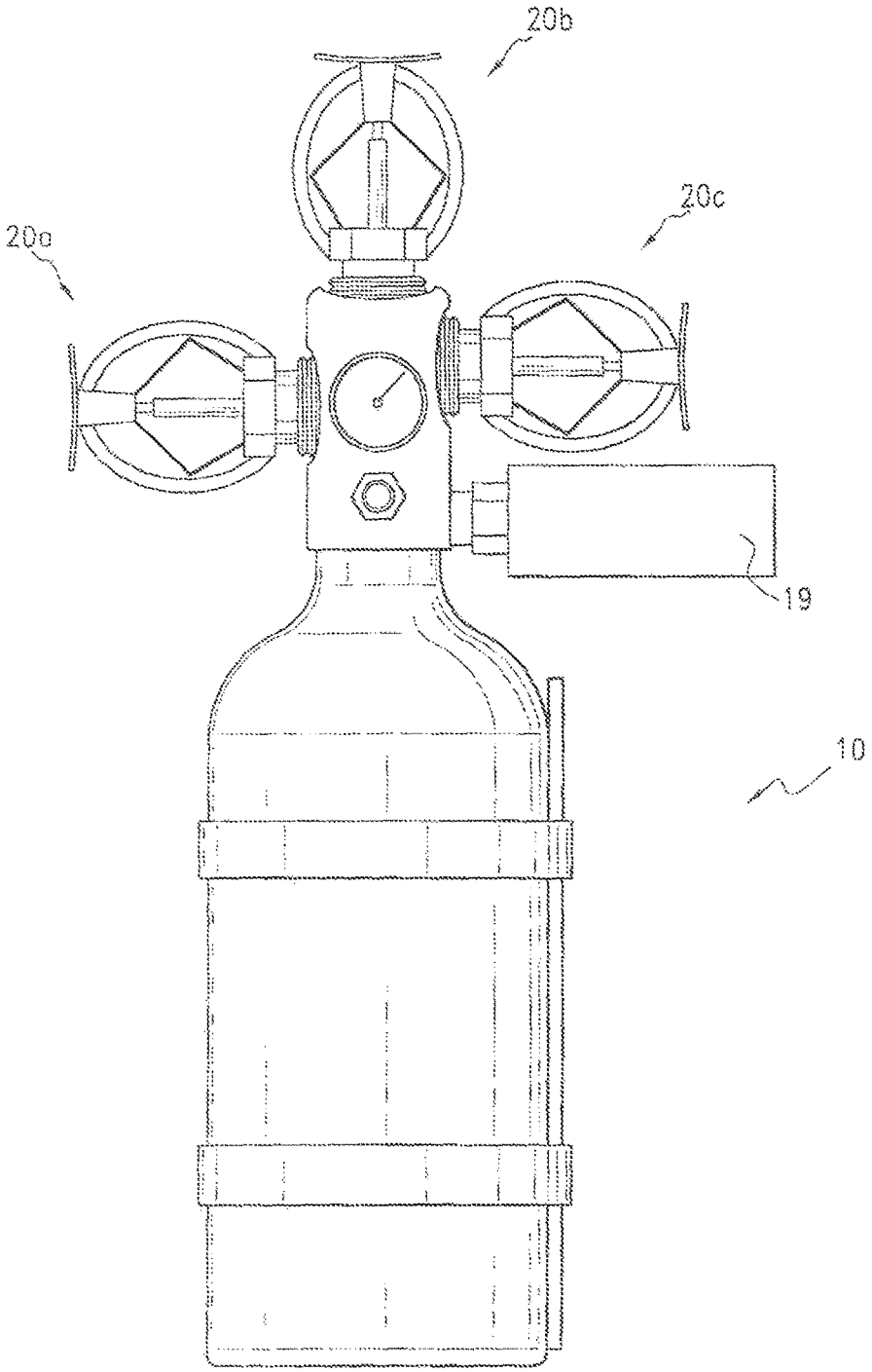
FIG. 4 is a side view of the fire-extinguishing device of the present invention having three sprinkler heads.

The fire-extinguishing device of the present invention can be provided with two discharge heads 20*a* and 20*b* as shown in FIG. 3, each discharge head having a heat sensing element (21*a*, 21*b*), plunger element (22*a*, 22*b*) and sprinkler head (24*a*, 24*b*) and being fluidly connected to the dispensing end 12 through a discharge outlet (15*a*, 15*b*). As shown in FIG. 4, the fire-extinguishing device of the present invention also can be provided with three discharge heads 20*a*, 20*b* and 20*c*, each having a heat sensing element, plunger element and sprinkler head, and each being fluidly connected to the dispensing end through a separate discharge outlet.

Figure 5:
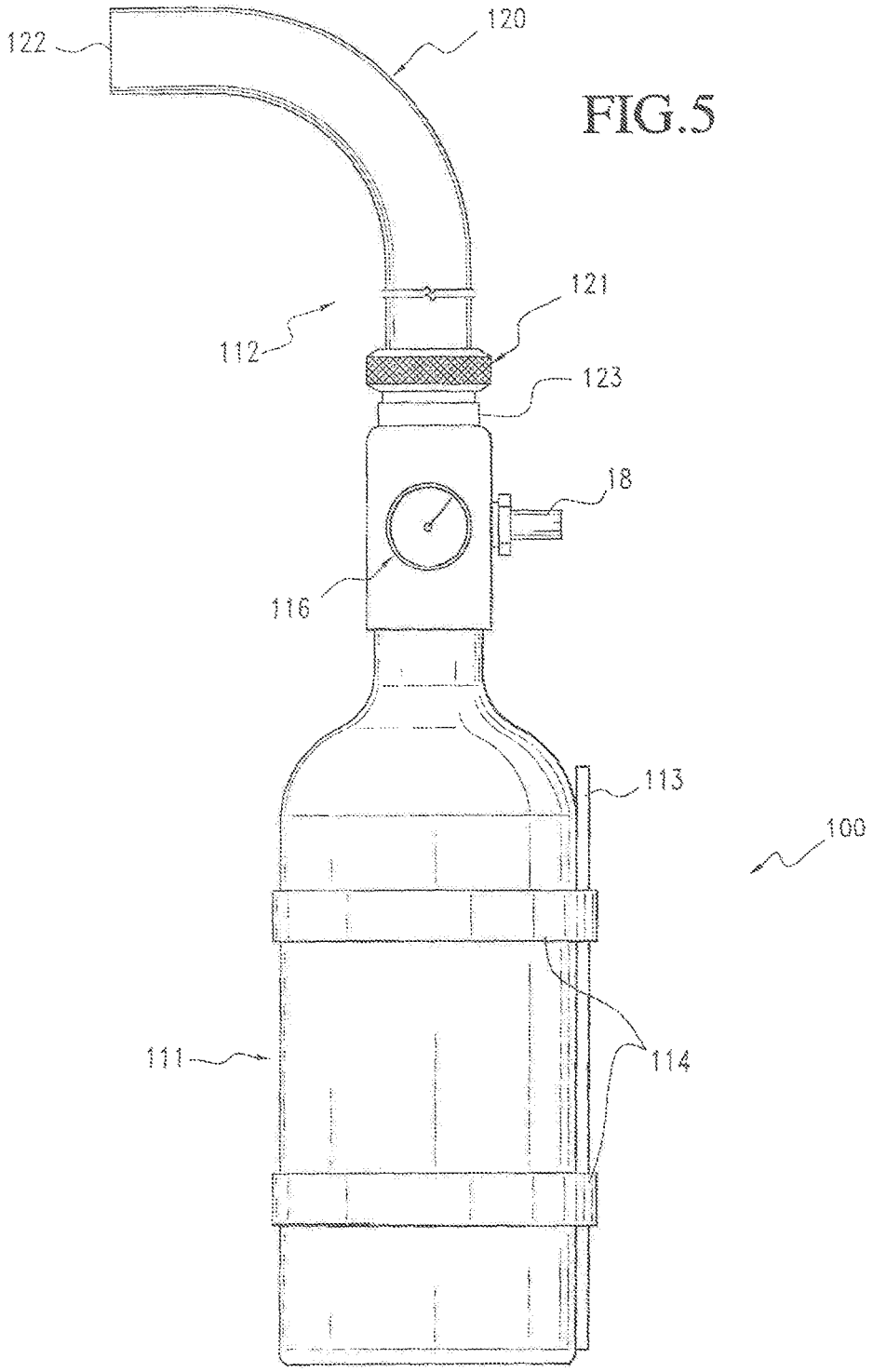
FIG. 5 is a side view of an alternative embodiment of the fire-extinguishing device of the present invention.

In an alternative embodiment of the present invention, the discharge head 20 of the fire-extinguishing device is replaced with a tubular discharge conduit having heating sensing means integrated therewith. More particularly, a fire-extinguishing device 100 is shown in FIG. 5, having a container body 111 tapering into a dispensing end 112, a mounting bracket 113, a pair of retaining straps 114, pressure gauge 116, fill valve 118 and a tubular discharge conduit 120 having a first end 121 fluidly connected to the dispensing end 112 by a discharge valve 123, and a closed second end 122. Preferably, the discharge conduit 120 is flexible such that it can be arranged to hang above a conventional stove. When discharge valve 123 is opened, fire-extinguishing agent from the container body 111 enters and fills the discharge conduit.

The tubular discharge conduit is composed of a material which is adapted to commence melting at a temperature between from about 145° F. to about 250'F., preferably from about 220° F. to about 250° P. Alternatively, the tubular discharge conduit is composed of a material having a high-melting point and is provided with a plurality of perforations which commence melting at a temperature of from about 145° P. to about 250° P., preferably from about 220° P. to about 250° P. In operation, when a fire breaks out on the stove top, the heat emanating from the fire will cause the heat-melting material to melt, thereby releasing the fire-extinguishing agent from the discharge conduit and onto the fire.

Figure 6A:
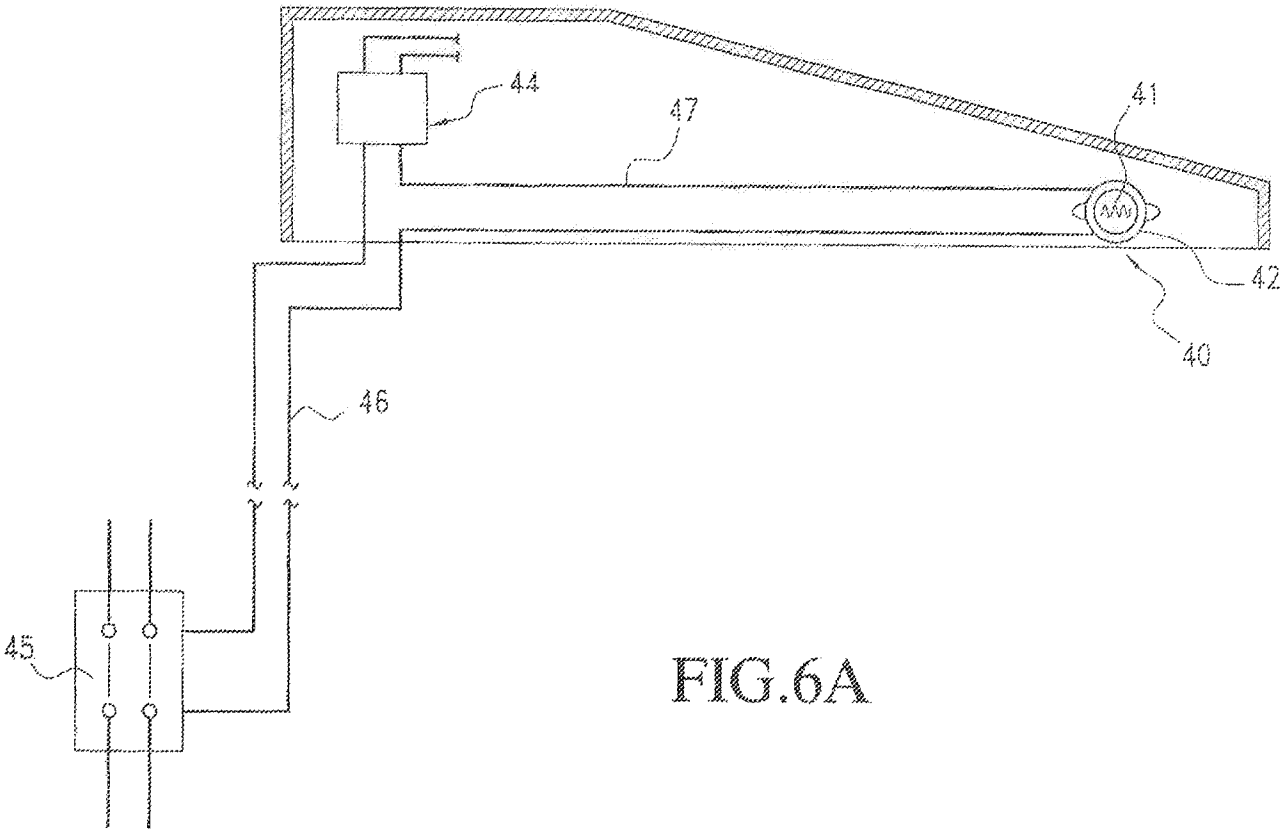
FIG. 6A is a schematic illustration of the automatic power shut off operation for an electric stove top of the fire-extinguishing system the present invention.
Figure 7A:
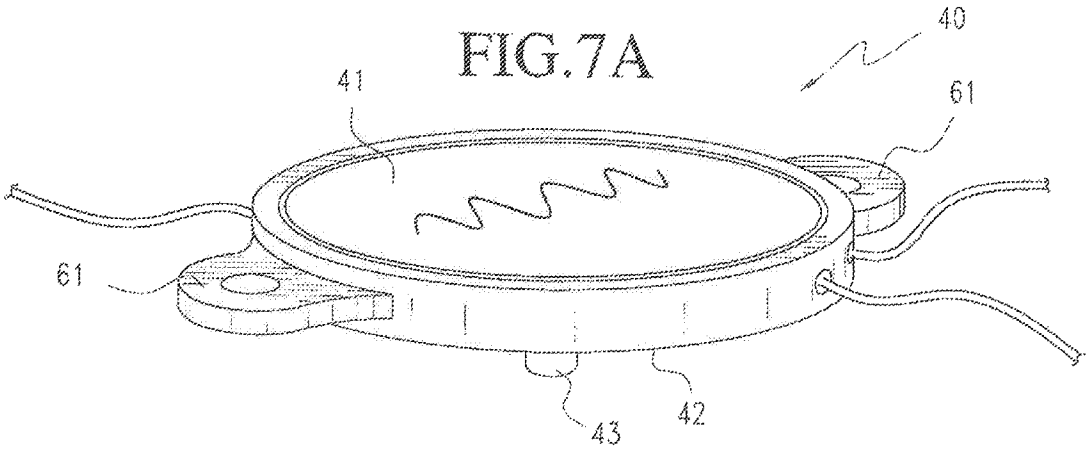
FIG. 7A is a perspective view of the heat sensing disc of the fire-extinguishing system of the present invention.

The cut-off control mechanism of the fire-extinguishing system of the present invention is designed to automatically terminate the power to the stove top. Referring now to FIG. 6A, the cut-off control mechanism for terminating the power to an electric stove top comprises a thermostatic bimetal limit switch 40 (hereinafter sometimes referred to as a heat sensing disc 40) having a first heat sensing surface 41 and a second surface 42. The heat sensing disc 40 is electrically connected to a 24-volt secondary power source 44, typically the power source for a transformer, the transformer typically being connected to the power source for a stove top vent hood. However, it is to be understood that any power source other than that utilized for the stove top is suitable for use in the present invention. The heat sensing disc 40 is installed above the stop top near the fire-extinguishing device of the present invention by means well known by those skilled in the art. Preferably, the heat sensing disc 40 is installed on the stove top vent hood or other nearby location by conventional means such as by a mounting bracket 61 as shown in FIG. 7A. The second surface 42 of the heat sensing disc 40 is provided with a reset control mechanism 43, such as a reset push button.

Figure 7B:
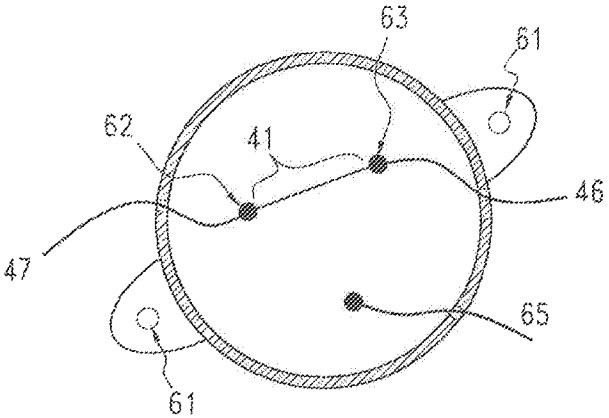
FIG. 7B is a schematic illustration of the electrical wiring of the non-actuated heat sensing disc used in the fire-extinguishing system of the present invention.
Figure 7C:
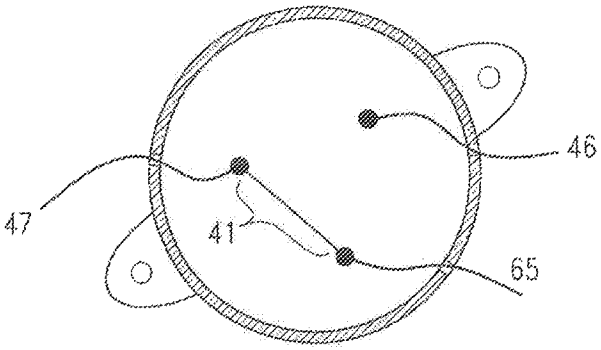
FIG. 7C is a schematic illustration of the electrical wiring of the actuated heat sensing disc used in the fire-extinguishing system of the present invention.

The heat sensing disc 40 is in electrical communication with an electromagnetic coil double pole contactor element 45 having a 24-volt coil by means of conventional 24-volt wiring 46 and is installed as a circuit breaker between the stove top's 220-volt power source and the stove top. In normal operation, the double pole contactor element 45 enables electric power to flow from the power source to the stove top as schematically illustrated in FIG. 7B. However, upon detection of an excessive temperature, the heat sensing disc 40 is actuated, thereby causing the contactor element 45 to break electricity from power source 46, thereby automatically terminating power to the stove top, as schematically illustrated in FIG. 7C. Actuation of the thermo disc 40 can be set for the detection of a predetermined temperature, such as 140° F. and can be manually reset by reset control mechanism 43.

More particularly and referring to FIGS. 7A and 7B, the electrical wiring of the heat sensing disc 40 includes the 24~volt control wire 47 from a transformer, a common lead single pole 62, a normally closed lead 63, a normally open lead 64, the heat sensing element 41, the 24-volt wiring to the double pole connector 46 and electrical wiring 65 provided for connection to accessories, such as an alarm system. In FIG. 7A, the stove is an electrical connection to the power source; in FIG. 7B, the heat sensing disc has been actuated, thereby breaking the electrical connection between the stove and power source.

Figure 6B:
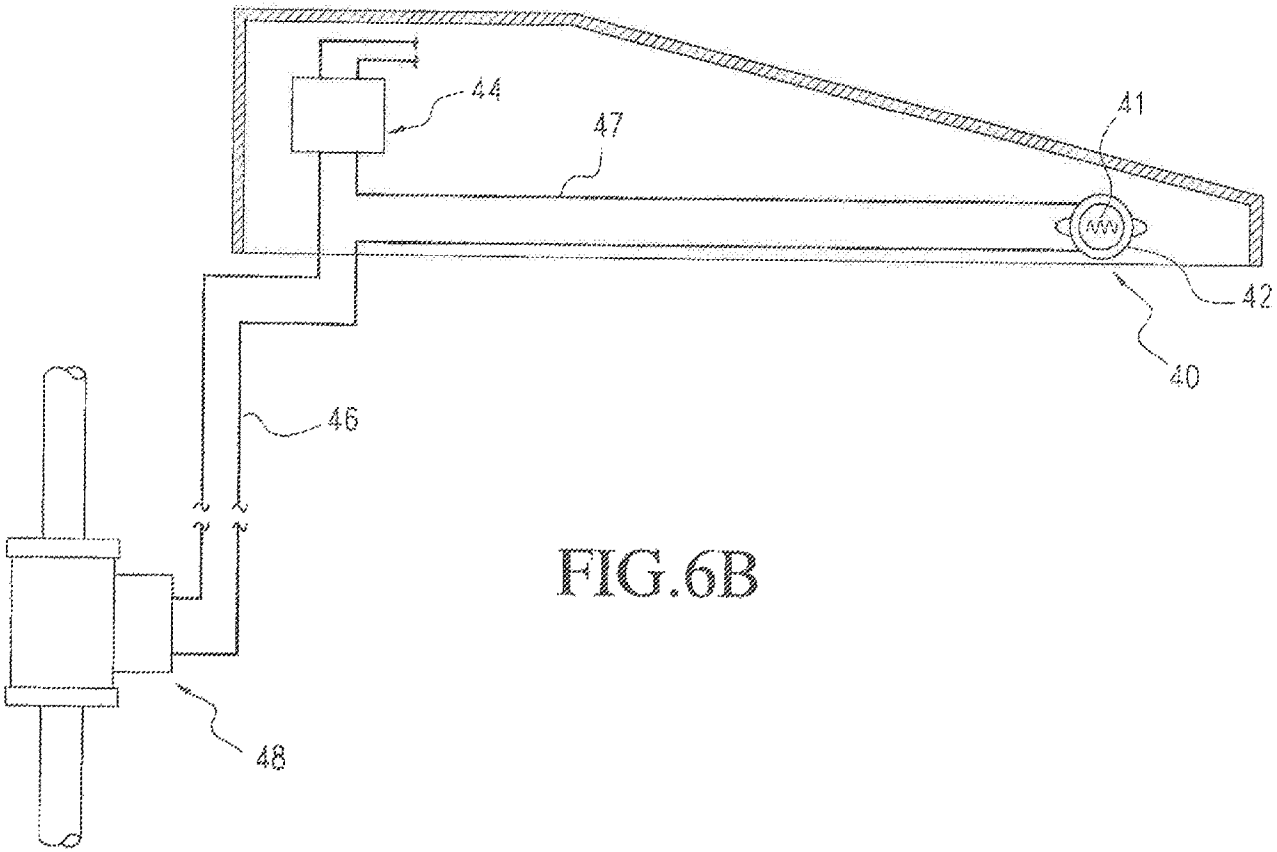
FIG. 6B is a schematic illustration of the automatic power shut off operation for a gas stove top of the fire-extinguishing system the present invention.

Referring now to FIG. 6B, the cut-off control mechanism for terminating the power to an gas stove top comprises a heat sensing disc 40 electrically connected to a power source 45 and in electrical communication with an electromagnetic coil and a solenoid valve 48 by conventional 24-volt electric wiring, the solenoid valve being installed between a gas supply line and the stove top. Upon detection of an excessive temperature, the heat sensing disc 40 is actuated and opens the electromagnetic coil voltage, thereby causing the solenoid valve 48 to close and shutting off the gas supply and automatically terminating power to the stove top.

Figure 8:
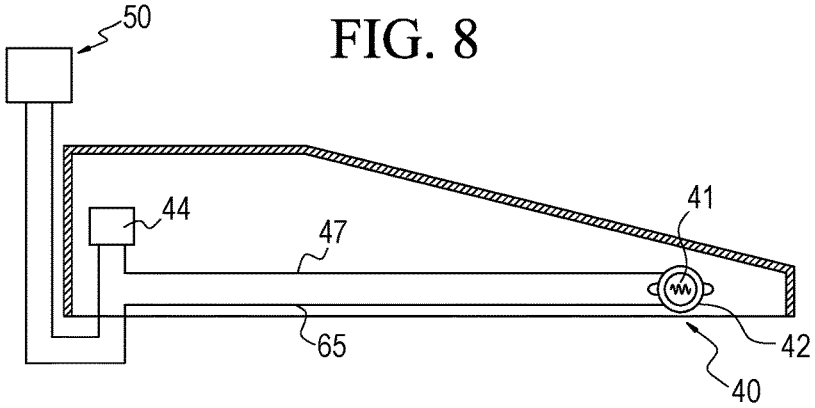
FIG. 8 is a schematic illustration of the audible and visual alarm of the fire-extinguishing system of the present invention.

The fire-extinguishing system of the present invention can be provided with an audible and or visual alarm which is activated by the heat sensing disc 40. Referring now to FIG. 8, an alarm 50 is in electric communication with the heat sensing disc 40. Upon detection of an excessive temperature, the heat sensing disc is actuated, thereby closing the contact 65 and supplying power to the accessory devices, thus powering the alarm 50. The alarm 50 can be in the form of an audible alarm, such as a warning horn, or a visual alarm, such as flashing light or strobe light, or a combination of both audible and visual alarms. The alarm 50 can be installed near the stove top or in another part of a dwelling and typically is powered by a 12-volt battery. In an alternative embodiment, the wiring 65 can be connected to an alarm system already present in the home, such as the burglar alarm of a home security system.

Figure 9:
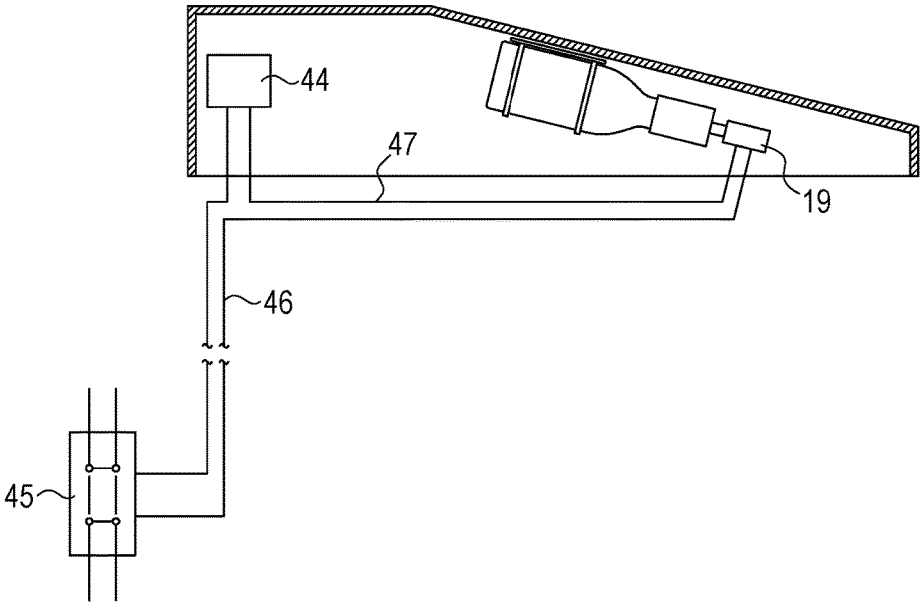
FIG. 9 is a schematic illustration of the pressure switch operation of the fire extinguishing system the present invention

As discussed above with reference to FIGS. 2, 3 and 4, the fire-extinguishing device 10 optionally can be provided with a pressure switch 19 which is adapted to terminate power to the stove top when the level of pressure in the container body drops below a predetermined pressure. As the pressure in the container body will drop when the fire-extinguishing device is discharging the fire-extinguishing agent from the container in response to a fire, the pressure switch 19 is an integrated cut-off control mechanism. Referring now to FIG. 9, the pressure switch 19, normally in a closed position, opens upon loss of pressure in the container. The pressure switch is electrically wired by conventional wiring 47 to a 24-volt power source, such as the power source from a transformer 44, typically connected to the power source of a stove top vent hood. However, it is to be understood that any power source is contemplated for use in the present invention. Once the pressure switch is open, it operates in the same manner as the heat sensing disc 40, either breaking the electrical circuit through the electromagnetic coils and double pole contactor or shutting off the gas supply through the electromagnetic coils and solenoid valve arrangement. The utilization of the pressure switch 19 can eliminate the need for a separate heat sensing disc 40.

While in the foregoing specification this invention has been described in relation to certain embodiments thereof, and many details have been put forth for the purpose of illustration, it will be apparent to those skilled in the art that the invention is susceptible to additional embodiments and that certain of the details described herein can be varied considerably without departing from the basic principles of the invention.

What I claim is:

1. A fire-extinguishing system adapted to be installed above a stove top and to automatically extinguish a fire emanating from said stove top, said fire-extinguishing system including a fire-extinguishing device comprising:

(a) a container body having a dispensing end, said container body adapted for storing a fire-extinguishing agent under pressure;

(b) a mounting mechanism adapted to secure the container body to a location in close proximity to said stove top;

(c) a discharge outlet in fluid communication with said dispensing end;

(d) a discharge head detachably and fluidly connected to said discharge outlet, said discharge head terminating into a sprinkler head adapted to discharge said fire-extinguishing agent, said discharge head further comprising:

(i) a plunger member disposed within said discharge head, said plunger member configured to be retained securely within said discharge outlet, and (ii) a heat sensing element disposed within said discharge head, said heat sensing element adapted to release said plunger member from said discharge outlet, wherein, when said heat sensing element reaches a predetermined temperature, said plunger member is released from said discharge outlet, thereby causing said fire-extinguishing agent head; and, (e) a pressure switch which is adapted to terminate power to the stove top when pressure of said fire extinguishing agent drops below a predetermined level in said container body.

2. The fire-extinguishing system in accordance with claim 1, wherein said heat sensing element is composed of a heat fusible material which has a melting temperature in a range of from about 140° F. and to about 290° F.

3. The fire-extinguishing system in accordance with claim 2, wherein, said plunger member is released from said discharge outlet upon said heat sensing element reaching said melting temperature.

4. The fire-extinguishing system in accordance with claim 1, wherein said heat sensing element is composed of a heat fusible material which has a melting temperature in a range of from about 225° F. to about 250° F.

5. The fire-extinguishing system in accordance with claim 1, further comprising:

(e) a second discharge outlet in fluid communication with said dispensing end, and (f) a second discharge head detachably and fluidly connected to said second discharge outlet, said second discharge head terminating into a second sprinkler head adapted to discharge said fire-extinguishing agent, said second discharge head further comprising:

(i) a second plunger member disposed within said second discharge head, said second plunger member configured to be retained securely within said second discharge outlet, and (ii) a second heat sensing element disposed within said second discharge head, said second heat sensing element adapted to release said second plunger member from said second discharge outlet.

6. The fire-extinguishing system in accordance with claim 5, further comprising:

(g) a third discharge outlet in fluid communication with said dispensing end, and (h) a third discharge head detachably and fluidly connected to said third discharge outlet, said third discharge head terminating into a third sprinkler head adapted to discharge said fire-extinguishing agent, said third discharge head further comprising:

(i) a third plunger member disposed within said third discharge head, said plunger member configured to be retained securely within said third discharge outlet, and (ii) a heat sensing element disposed within said third discharge head, said heat sensing element adapted to release said third plunger member from said third discharge outlet.

7. The fire-extinguishing system in accordance with claim 1, wherein said pressure switch is electrically connected to a contactor element, said contactor element adapted to be used as a circuit breaker when installed between an electric stove top and its power source, wherein, in normal operation, said contactor element enables electricity to flow to said electric stove top from its power source, and wherein, upon detection of a predetermined level of pressure in said container body, said pressure switch causes said contactor element to terminate the flow of electricity to said electric stove top.

8. The fire-extinguishing system in accordance with claim 1, wherein said pressure switch is electrically connected to a solenoid valve, said solenoid valve being installed between a gas stove top and a gas supply line, wherein, in normal operation, said solenoid valve enables gas to flow through said gas supply line and to said gas electric stove top, and wherein, upon detection of a predetermined level of pressure, said pressure switch is actuated to cause said solenoid valve to close, thereby terminating the flow of gas from a gas supply line to said gas stove top.

9. A fire-extinguishing system adapted to be installed above a stove top and to automatically extinguish a fire emanating; from said stove top, said fire-extinguishing system including a fire-extinguishing device comprising:

(a) a container body having a dispensing end, said container body adapted for storing a fire-extinguishing agent under pressure;

(b) a mounting mechanism adapted to secure the container body to a location in close proximity to said stove top;

(c) a discharge outlet in fluid communication with said dispensing end;

(d) a discharge head detachably and fluidly connected to said discharge outlet, said discharge head terminating into a sprinkler head adapted to discharge said fire-extinguishing said discharge head further comprising:

(i) a plunger member disposed within said discharge head, said plunger member configured to be retained securely within said discharge outlet, and (ii) a heat sensing element disposed within said discharge head said heat sensing element adapted to release said plunger member from said discharge outlet, wherein, when said heat sensing element reaches a predetermined temperature, said plunger member is released from said discharge outlet, thereby causing said fire-extinguishing agent head; and, (e) a cut-off control mechanism for terminating power to an electric stove top, said cut-off control mechanism comprising:

(a) a heat sensing disc having a first heat sensing surface and a second surface, said heat sensing disc adapted to be electrically connected to a secondary power source, and (b) a contactor element adapted to be used as a circuit breaker when installed between an electric stove top and a primary power source, said contactor element being in electrical communication with said heat sensing disc by means of electrical wiring, wherein, in normal operation, said contactor element enables electricity to flow to an electric stove top from said primary power source, and wherein, upon detection of a predetermined temperature, said heat sensing disc is actuated to cause said contactor element to terminate the flow of electricity to an electric stove top.

10. The fire-extinguishing system in accordance with claim 9, wherein said heat sensing disc is a thermostatic bimetal limit switch.

11. The fire-extinguishing system in accordance with claim 9 wherein said second surface of said heat sensing disc is provided with a reset control mechanism.

12. The fire-extinguishing system in accordance with claim 9 further comprising an alarm system, wherein said heat sensing disc is in electrical communication with said alarm system in such a manner that actuation of said heat sensing disc activates said alarm system.

13. A fire-extinguishing system adapted to be installed above a stove top and to automatically extinguish a fire emanating from said stove top, said fire-extinguishing system including a fire-extinguishing device comprising:

(a) a container body having a dispensing end, said container body adapted for storing a fire-extinguishing agent under pressure;

(b) a mount mechanism adapted to secure the container body to a location in close proximity to said stove top;

(c) a discharge outlet in fluid communication with said dispensing end;

(d) a discharge head detachably and fluidly connected to said discharge outlet, said discharge head terminating into a sprinkler head adapted to discharge said fire-extinguishing agent, said discharge head further comprising:

(i) a plunger member disposed within said discharge head, said plunger member configured to be retained securely within said discharge outlet, and (ii) a heat sensing element disposed within said discharge head, said heat sensing element adapted to release said plunger member from said discharge outlet, wherein, when said heat sensing element reaches a predetermined temperature, said plunger member is released from said discharge outlet, thereby causing said fire-extinguishing agent contained within said container body to exit through said discharge outlet and to said sprinkler head; and, (e) a cut-off control mechanism for terminating power to a gas stove top, said cut-off control mechanism comprising:

(a) a heat sensing disc having a first heat sensing surface and a second surface, said heat sensing disc adapted to be electrically connected to a power source, and (b) a solenoid valve installed between a gas stove top and a gas supply line, said power source, said solenoid valve being in electrical communication with said heat sensing disc by means of electrical wiring, wherein, in normal operation, said solenoid valve enables gas to flow through said gas supply line and to a gas electric stove top, and wherein, upon detection of a predetermined pressure in said container body, said heat sensing disc is actuated to cause said solenoid valve to close, thereby terminating the flow of gas from said gas supply line to a gas stove top.

14. The fire-extinguishing system in accordance with claim 13, wherein said heat sensing disc is a thermostatic bimetal limit switch.

15. The fire-extinguishing system in accordance with claim 13, wherein said second surface of said heat sensing disc is provided with a reset control mechanism.

16. The fire-extinguishing system in accordance with claim 13, further comprising an alarm system, wherein said heat sensing disc is in electrical communication with said alarm system in such a manner that actuation of said heat sensing disc activates said alarm system.

* * * * *